US007874801B2

(12) United States Patent
Schmidt

(10) Patent No.: US 7,874,801 B2
(45) Date of Patent: Jan. 25, 2011

(54) DEVICE FOR MEASURING THE DISPLACEMENT TRAVEL OF A HYDRAULIC DISPLACEMENT MECHANISM

(75) Inventor: Jörg Schmidt, Zweibrücken (DE)

(73) Assignee: TLT-Turbo GmbH (DE)

( * ) Notice: Subject to any disclaimer, the term of this patent is extended or adjusted under 35 U.S.C. 154(b) by 869 days.

(21) Appl. No.: 11/759,477

(22) Filed: Jun. 7, 2007

(65) Prior Publication Data

US 2007/0286730 A1 Dec. 13, 2007

(30) Foreign Application Priority Data

Jun. 7, 2006 (DE) ..... 10 2006 026 834

(51) Int. Cl.
*B64C 11/32* (2006.01)

(52) U.S. Cl. ..... 416/156; 416/157 R

(58) Field of Classification Search ..... 416/156, 416/157 R; 91/5 R; 324/207.21
See application file for complete search history.

(56) References Cited

U.S. PATENT DOCUMENTS

| | | | | |
|---|---|---|---|---|
| 3,898,555 | A | 8/1975 | Tellerman | |
| 5,150,049 | A * | 9/1992 | Schuetz | 324/207.12 |
| 5,717,330 | A * | 2/1998 | Moreau et al. | 324/207.13 |
| 6,087,828 | A | 7/2000 | Miwa | |
| 6,644,922 | B2 | 11/2003 | McCallum et al. | |
| 6,767,187 | B2 * | 7/2004 | Franchet et al. | 416/157 R |

FOREIGN PATENT DOCUMENTS

| | | |
|---|---|---|
| CH | 449 837 | 1/1968 |
| DE | 1 428 100 | 9/1969 |
| DE | 24 46 161 | 4/1977 |
| DE | 36 18 183 | 8/1987 |
| DE | 202 18 754 | 2/2003 |
| DE | 10 2004 044 950 | 3/2006 |
| JP | 59 115499 | 3/1984 |

* cited by examiner

*Primary Examiner*—Ninh H Nguyen
(74) *Attorney, Agent, or Firm*—Robert W. Becker & Associates; Robert W. Becker

(57) ABSTRACT

A device for measuring the displacement travel of a hydraulic displacement mechanism for blades of an impeller of an axial-flow fan, wherein the displacement mechanism includes as components a displacement cylinder and a piston rod having a piston, one of the components being axially displaceable and the other component not being axially displaceable. Respective spindles of the blades are secured to a displacement disk to which is connected the axially displaceable component of the displacement mechanism. An oil transfer element surrounds an extension of the piston rod that extends out of the displacement cylinder. A magnetostrictive displacement-measuring device that includes a sensor housing with a wave guide, sensor head, and an annular magnet is coupled to the displacement mechanism. The sensor housing and the sensor head are connected to the oil transfer element. Either the oil transfer element or one of the displacement mechanism components is axially displaceable relative to the other component. The magnet is connected to that component for which the axial displacement relative to the oil transfer element exists.

6 Claims, 2 Drawing Sheets

DEVICE FOR MEASURING THE DISPLACEMENT TRAVEL OF A HYDRAULIC DISPLACEMENT MECHANISM

The instant application should be granted the priority date of May 5, 2006 the filing date of the corresponding German patent application 10 2006 026 834.2.

BACKGROUND OF THE INVENTION

The present invention relates to a device for measuring the to displacement travel of a hydraulic displacement mechanism for the blades of the impeller of an axial-flow fan.

Modern axial-flow fans are regulatable work machines that convert mechanical energy into kinetic energy. The regulation of the axial-flow fans is effected by the speed or the angle of the blade. If the position of the blade is to be altered during operation, the blade must be secured to a supported shaft via the spindle. The alteration of the blade position is generally effected hydraulically. For this purpose, a hydraulic displacement mechanism is installed on the impeller of the axial-flow fan. Such a displacement mechanism is essentially comprised of a hydraulic displacement cylinder arrangement that rotates with the speed of the fan, and a non-rotating oil transfer element to which the oil supply lines are connected.

The position of the blades of the axial-flow fan correspond to a specific position of the displacement cylinder arrangement. This position is indicated externally of the fan housing, via a position indicator that is mechanically connected to the displaceable component of the displacement cylinder arrangement, and can also be conveyed to an observation means by means of an attached angle coder. Such a mechanical arrangement for indicating position is relatively imprecise. Furthermore, due to the mechanical connection wear in the connecting parts must be taken into consideration.

The present invention deals with the problem of providing an advantageous device for measuring the displacement travel of the hydraulic displacement mechanism of axial-low fans. Such a device must be suitable for the measuring inset on the blade adjustment device in the hub space of the axial-flow fan.

It is an object of the present invention to provide a displacement-measuring device for a device of the aforementioned general type that operates with relatively great precision, delivers absolute values, and is free of wear.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
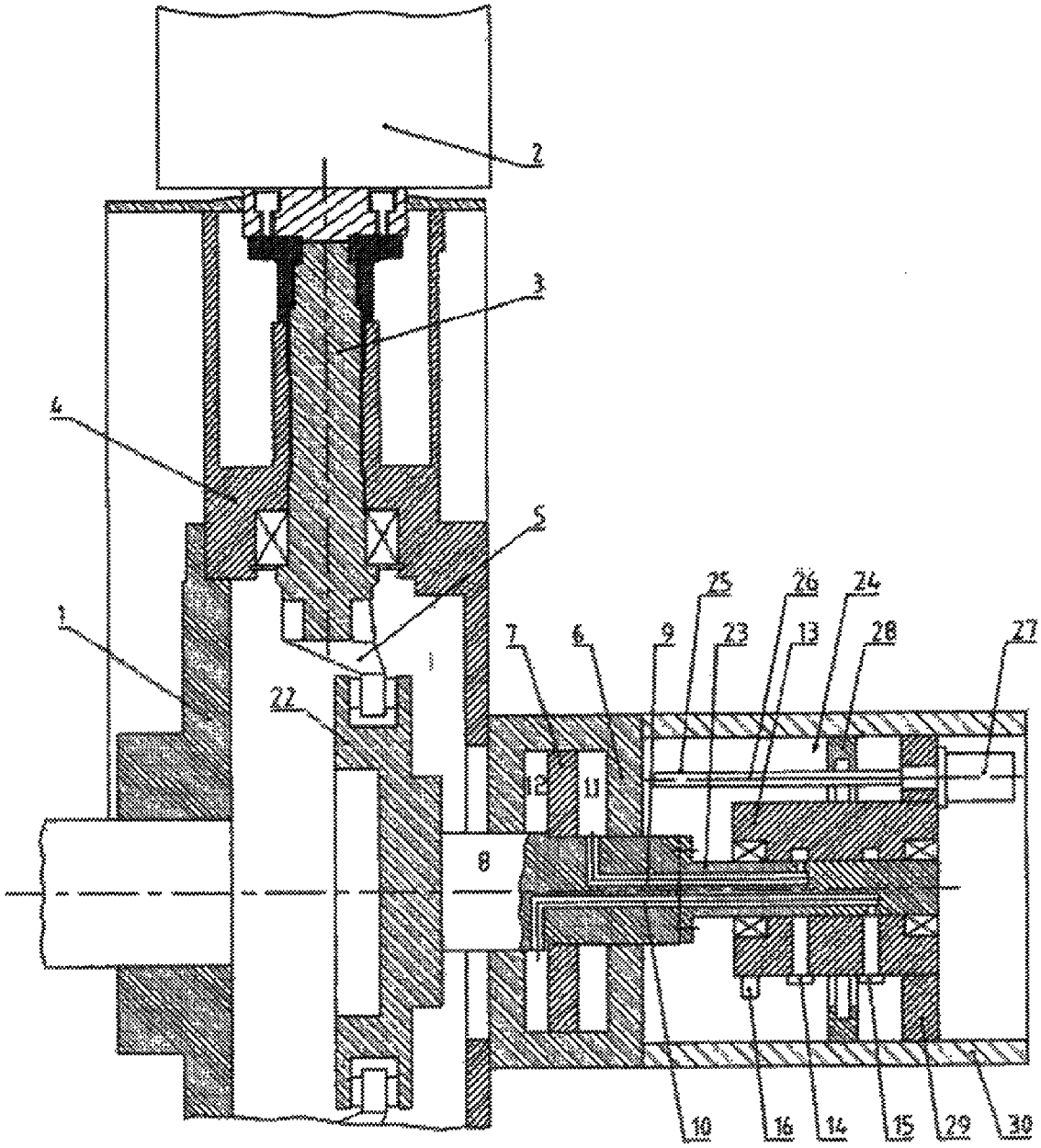
FIG. 1 is a longitudinal cross-sectional view through an impeller of an axial-flow fan having a displacement mechanism according to the invention.

The device of the present application for measuring the displacement travel of a hydraulic displacement mechanism for blades of an impeller of an axial-flow fan comprises a displacement mechanism that includes as components a displacement cylinder and a piston rod having a piston, wherein one of the components is axially displaceable and the other component is not axially displaceable; a displacement disk to which are secured, via rotatable displacement levers, respective spindles of the blades, wherein the axially displaceable one of the components is connected to the displacement disk; an oil transfer element that is adapted to supply oil to the displacement cylinder, wherein the oil transfer element surrounds an extension of the piston rod that extends out of the displacement cylinder, and a magnetostrictive displacement-measuring device that includes a sensor housing having a wave guide, a sensor head, and an annular magnet, wherein the displacement mechanism is coupled to the displacement-measuring device, wherein the sensor housing and the sensor head of the displacement-measuring device are connected with the oil transfer element, wherein one of either the oil transfer element or one of the components of the displacement mechanism is to axially displaceable relative to the other component, and wherein the annular magnet is disposed on that component of the displacement mechanism for which said axial displacement relative to the oil transfer element exists.

The realization of the object is in the use of a magnetostrictive displacement-measuring device for the indicated purpose. Magnetostrictive displacement-measuring devices are known, for example, from U.S. Pat. No. 3,898,555 A. The devices are characterized by a relatively high precision, a low linearity tolerance, and a very high precision of measuring reproducibility. The displacement-measuring devices deliver an absolute value measurement, so that encountering or approaching a reference marked can be dispensed with. Finally, the measuring system operates without contact, so that no wear occurs between the components of the measuring system and of the displacement mechanism that rotate and are displaceable relative to one another. Pursuant to the invention, the magnetostrictive displacement-measuring devices are installed on the blade adjustment device in the hub space of the axial-flow fan and are advantageously adapted to the special structural conditions that exist there.

Further specific features and advantages of the present invention will be described in detail subsequently.

DESCRIPTION OF SPECIFIC EMBODIMENTS

Referring now to the drawings in detail, a rotor or impeller 1 of an axial-flow fan is provided on its periphery with a plurality of vanes or blades 2, one of which is partially shown. The blades 2 are adjustable about their longitudinal axis to adapt the axial-flow fan to the various operating conditions. For this purpose, a spindle 3 that supports the blades 2 is rotatably mounted in a support ring 4 of the impeller 1. Secured to each spindle 3 is an offset displacement lever 5, which is guided in a groove disposed on the periphery of an adjustment disk 22.

Pursuant to FIG. 1, the adjustment disk 22 is connected to a piston rod 8 on which is secured a piston 7. The piston 7 in turn is disposed within a displacement cylinder 6. The piston rod 8, along with the piston 7 and the adjustment disk 22, are disposed so as to be displaceable along the axis of the axial-flow fan, and rotate at the same speed as do the impeller 1 and the displacement cylinder 6. The displacement cylinder 6 is connected to the impeller 1, and is stationary relative to the piston rod 8 and the piston 7.

For extension purposes, that end of the piston rod 8 that is remote from the impeller 1 is screw-connected to a shaft 23 that rotates within a non-rotating oil transfer element 13. Axially extending control channels 9, 10 are guided through the piston rod 8 and the shaft 23 and respectively open out into a piston chamber 11, 12 disposed on to the two sides of the piston 7. The oil transfer element 13 serves for supplying the displacement cylinder 6 with oil under pressure, and is provided with a leakage oil outlet 16 and with two supply lines 14, 15 for the two piston chambers 11, 12. The supply lines 14, 15 serve the respective piston chamber not only as a feed but also as a return, depending upon in which direction the piston 7 is to be displaced on the piston rod 8 with the adjustment disk 22.

To measure the displacement stroke or travel that the piston 7 carries out on the piston rod 8 for adjusting the blades 2, a magnetostrictive displacement-measuring device 24 is provided, such as is known, for example, from U.S. Pat. No. 3,398,555 A.

In the illustrated embodiment, the magnetostrictive displacement-measuring device 24 is comprised of various components, and in particular a rod-shaped sensor housing 25 that surrounds a wave guide 26 of ferromagnetic material, a sensor head 27 that is connected to the sensor housing 25 and carries the electronics for signal preparation, and a permanent magnet 28, as a position transmitter or indicator, that is movable relative to the sensor housing 25. The sensor housing 25 can also be embodied as a profiled design or the like.

Pursuant to FIG. 1, the sensor head 27, together with the rod-shaped sensor housing 25 of the magnetostrictive displacement-measuring device 24, is fixedly disposed in an annular flange 29 that is secured to the oil transfer element 13. In this connection, the sensor housing 25 is oriented in the direction of the axis of the axial-flow fan, and hence in the direction of movement of the piston rod 8. Instead of one displacement-measuring device 24, as illustrated, it would also be possible to dispose a plurality of displacement-measuring devices in the annular flange 29 of the oil transfer element 13.

The magnet 28 of the magnetostrictive displacement-measuring device 24 is embodied as an annular magnet having an internal magnetic band. The magnet 28 thus surrounds the sensor housings 25 of all mounted or installed magnetostrictive displacement-measuring devices 24 in a predetermined zone.

The displacement-measuring device 24 and the oil transfer element 13 are surrounded by a protective tube 30 that is connected to the displacement cylinder 6. The annular magnet 28 is secured to the wall of the protective tube 30. Thus, the protective tube 30 serves as a support for the magnet 28. The protective tube 30, along with the magnet 28, rotates with the speed of the axial-flow fan. The annular flange 29, as well as the sensor housing 25 that is secured to the annular flange, do not rotate.

In order to adjust the blades 2 of the axial-flow fan, the piston rod 8, and hence also the oil transfer element 13, are moved axially. In so doing, when viewed in an axial direction the magnet 28, which is secured to the protective tube 30 that is connected to the displacement cylinder 6, remains in its position. The displacement-measuring device 24, which is comprised of the sensor housing 25 and the sensor head 27, along with the annular flange 29, are moved on the oil transfer element 13, and thus deliver the displacement travel as a displacement signal.

Figure 2:
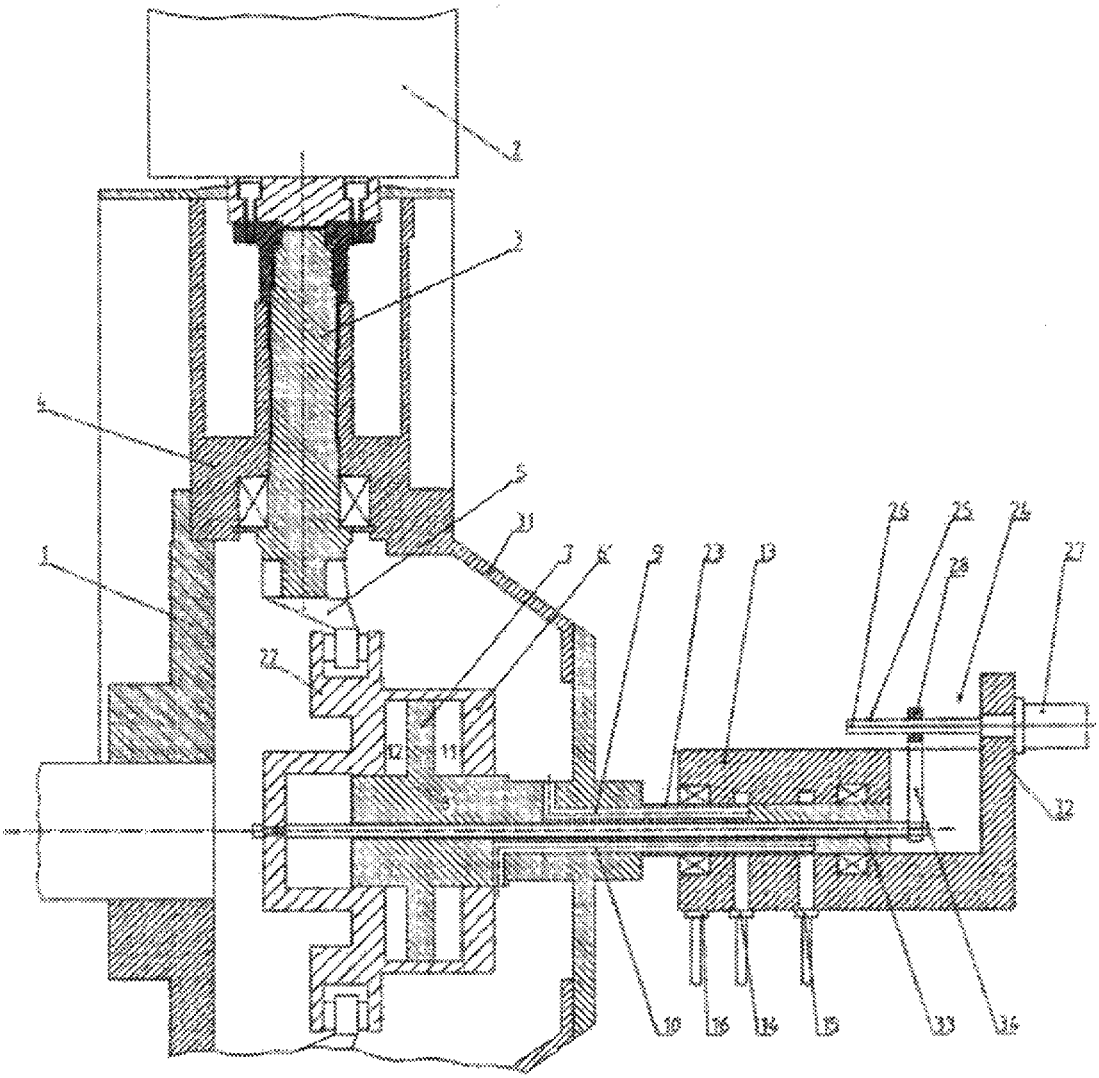
FIG. 2 is a longitudinal cross-sectional view through an impeller of an axial-flow fan having a displacement to mechanism pursuant to another embodiment.

The embodiment of a displacement mechanism for an axial-flow fan illustrated in FIG. 2 corresponds in its manner of operation to the displacement mechanism illustrated in FIG. 1. However, in contrast to FIG. 1 the displacement cylinder 6' of the displacement mechanism of FIG. 2 can be displaced axially, and the piston rod 8' is disposed so as not to be displaceable axially.

The displacement cylinder 6' is fixedly connected with the axially displaceable adjustment disk 22. The piston rod 8', with the piston 7 secured thereto, is connected to the impeller 1 by means of a conical support 31. That end of the piston rod 8' that is remote from the impeller 1 rotates as a shaft 23 within the nonrotating oil transfer element 13.

With the displacement mechanism illustrated in FIG. 2, the to sensor head 27, together with the rod-shaped sensor housing 25 of the magnetostrictive displacement-measuring device 24, are fixedly disposed in a support flange 32. The support flange 32 is secured to the oil transfer element 13, which here is not axially displaceable. In this connection, the sensor housing 25 is oriented in the direction of the axis of the axial-flow fan and hence in the direction of movement of the displacement cylinder 6'. Instead of one displacement-measuring device 24 as illustrated, it would also be possible to dispose a plurality of displacement-measuring devices in the support flange 32 of the oil transfer element 13.

The magnet 28 of the magnetostrictive displacement-measuring device 24 is embodied as an annular magnet that surrounds the sensor housing. Each magnetostrictive displacement-measuring device 24 that is installed or used has its own magnet 28.

The displacement cylinder 6' is fixedly connected to a return rod 33 that carries out the same axial movement as does the displacement cylinder. The return rod 33 is fixedly connected with a support 34 on which, in turn, are secured the magnet 28 or the magnets 28 of the possible multiple displacement-measuring devices.

To adjust the blades 2 of the axial-flow fan, the displacement cylinder 6', and hence also the displacement disk 22 and the return rod 33, are moved axially. In so doing, the position of the magnet 28 is also moved axially. The displacement measuring device 24, which is comprised of the sensor housing 25 and the sensor head 27, and the support flange 32 on the oil transfer element 13, do not move axially. The displacement-measuring device 24 thus delivers the displacement travel as a displacement signal.

The specification incorporates by reference the disclosure of German priority document 10 2006 026 834.2 filed Jun. 7, 2006.

The present invention is, of course, in no way restricted to the specific disclosure of the specification and drawings, but also encompasses any modifications within the scope of the appended claims.

What I claim is:

1. A device for measuring the displacement travel of a hydraulic displacement mechanism for blades of an impeller of an axial-flow fan, comprising:

a displacement mechanism that includes as components a displacement cylinder and a piston rod having a piston, wherein one of said components is axially displaceable and the other component is not axially displaceable;

a displacement disk to which are secured, via rotatable displacement levers, respective spindles of said blades, wherein said axially displaceable one of said components of said displacement mechanism is connected to said displacement disk, wherein said displacement disk is rotatable;

an oil transfer element that is adapted to supply oil to said displacement cylinder, wherein said oil transfer element surrounds an extension of said piston rod that extends out of said displacement cylinder, wherein said oil transfer element is non-rotatable; and a magnetostricitive displacement-measuring device that includes a sensor housing having a wave guide, a sensor head, and an annular magnet, wherein said displacement mechanism is coupled to said magnetostrictive displacement-measuring device, wherein said sensor housing and said sensor head of said magnetostrictive displacement-measuring device are connected with said oil transfer element, wherein either said oil transfer element or one of said components of said displacement mechanism is axially displaceable relative to the other component of said displacement mechanism, and wherein said annular magnet is connected to that component of said displacement mechanism for which said axial displacement relative to said oil transfer element exists.

2. A device according to claim 1, wherein a protective tube (30) is connected to said displacement cylinder as the axially not displaceable component, wherein said magnetostrictive displacement-measuring device is surrounded by said protective tube, and wherein said annular magnet of said magnetostrictive displacement-measuring device is secured to said protective tube.

3. A device according to claim 2, wherein said oil transfer element surrounds said extension of said piston rod as said axially displaceable component, wherein said oil transfer element is provided with an annular flange, and wherein said sensor housing and said sensor head of at least one magnetostrictive displacement-measuring device are secured in said annular flange.

4. A device according to claim 1, wherein said annular magnet (28) of said magnetostrictive displacement-measuring device is indirectly connected to said displacement disk, which is axially displaceable.

5. A device according to claim 4, wherein a return rod is guided through said piston rod wherein one end of said return rod is connected to said displacement disk, and wherein said annular magnet (28) of said magnetostrictive displacement-measuring device is secured to another end of said return rod via a support.

6. A device according to claim 4, wherein said oil transfer element is provided with a support flange, and wherein said sensor housing and said sensor head of at least one magnetostrictive displacement-measuring device are secured in said support flange.

* * * * *